US009824569B2

(12) United States Patent
Snodgrass

(10) Patent No.: US 9,824,569 B2
(45) Date of Patent: Nov. 21, 2017

(54) WIRELESS COMMUNICATION FOR DISPENSER BEACONS

(71) Applicant: Ecolab USA Inc., St. Paul, MN (US)

(72) Inventor: David Snodgrass, Jupiter, FL (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 15/406,129

(22) Filed: Jan. 13, 2017

(65) Prior Publication Data

US 2017/0200360 A1 Jul. 13, 2017

Related U.S. Application Data

(63) Continuation of application No. 14/164,930, filed on Jan. 27, 2014, now abandoned.

(60) Provisional application No. 61/756,791, filed on Jan. 25, 2013.

(51) Int. Cl.

| | |
|---|---|
| ***G08B 21/00*** | (2006.01) |
| ***G08B 21/18*** | (2006.01) |
| ***G08B 25/10*** | (2006.01) |

(52) U.S. Cl.

CPC ..... *G08B 21/18* (2013.01); *G08B 25/10* (2013.01)

(58) Field of Classification Search

CPC ..... G08B 21/18; G08B 25/10
USPC ..... 340/612, 603, 539.1
See application file for complete search history.

(56) References Cited

U.S. PATENT DOCUMENTS

| | | | |
|---|---|---|---|
| 3,736,584 | A | 5/1973 | Hackett et al. |
| 3,761,909 | A | 9/1973 | Schweitzer et al. |
| 3,786,467 | A | 1/1974 | Cotter |
| 3,801,977 | A | 4/1974 | Cotter |
| 3,866,198 | A | 2/1975 | Cohen |
| 3,961,321 | A | 6/1976 | Moss |
| 3,986,182 | A | 10/1976 | Hackett |
| 4,076,146 | A | 2/1978 | Lausberg et al. |
| 4,083,298 | A | 4/1978 | Schotten |
| 4,117,462 | A | 9/1978 | Miller |
| 4,198,618 | A | 4/1980 | Kleinschmidt |
| 4,209,776 | A | 6/1980 | Frederick |
| 4,275,390 | A | 6/1981 | Heywang et al. |
| 4,319,349 | A | 3/1982 | Hackett |
| 4,360,905 | A | 11/1982 | Hackett |
| 4,380,726 | A | 4/1983 | Sado et al. |
| 4,486,910 | A | 12/1984 | Saalmann et al. |

(Continued)

FOREIGN PATENT DOCUMENTS

| | | | |
|---|---|---|---|
| AU | 2015258158 | A1 | 12/2015 |
| CA | 2592814 | A1 | 12/2007 |

(Continued)

OTHER PUBLICATIONS

Al-Hamad et al., "How Clean is Clean? Proposed Methods for Hospital Cleaning Assessment," Journal of Hospital Infection, vol. 70, Oct. 9, 2008, pp. 328-334.

(Continued)

*Primary Examiner* — Kerri McNally
(74) *Attorney, Agent, or Firm* — Shumaker & Sieffert, P.A.

(57) ABSTRACT

A communication system for hygiene compliance monitoring comprising a plurality of hygiene dispensers for dispensing hygiene product, each dispenser having a transmitter for transmitting data indicating the status of dispenser, such as product remaining in the dispenser to a central monitoring station.

13 Claims, 1 Drawing Sheet

(56) References Cited

U.S. PATENT DOCUMENTS 4,539,846 A 9/1985 Grossman
4,590,460 A 5/1986 Abbott et al.
4,606,085 A 8/1986 Davies
4,644,509 A 2/1987 Kiewit et al.
4,688,585 A 8/1987 Vetter
4,727,522 A 2/1988 Steiner et al.
4,729,120 A 3/1988 Steiner et al.
4,839,597 A 6/1989 Rowland
4,896,144 A 1/1990 Bogstad
4,987,402 A 1/1991 Nykerk
4,991,146 A 2/1991 Ransdell et al.
5,083,298 A 1/1992 Citterio et al.
5,110,364 A 5/1992 Mazur et al.
5,150,099 A 9/1992 Lienau
5,153,520 A 10/1992 Dumbeck
5,202,666 A 4/1993 Knippscheer
5,245,317 A 9/1993 Chidley et al.
5,263,006 A 11/1993 Hermesmeyer
5,309,409 A 5/1994 Jones et al.
5,370,267 A 12/1994 Schroeder
5,390,385 A 2/1995 Beldham
5,430,293 A 7/1995 Sato et al.
5,463,595 A 10/1995 Rodhall et al.
5,467,481 A 11/1995 Srivastava
5,570,079 A 10/1996 Dockery
5,610,589 A 3/1997 Evans et al.
5,625,659 A 4/1997 Sears
5,661,471 A 8/1997 Kotlicki
5,684,458 A 11/1997 Calvarese
5,687,717 A 11/1997 Halpern et al.
5,695,091 A 12/1997 Winings et al.
5,731,526 A 3/1998 Kindrick
5,764,136 A 6/1998 Harron
5,765,605 A 6/1998 Waymire et al.
5,771,925 A 6/1998 Lewandowski
D396,009 S 7/1998 Reubens
H1743 H 8/1998 Graves et al.
5,793,653 A 8/1998 Segal
5,812,059 A 9/1998 Shaw et al.
5,887,145 A 3/1999 Harari et al.
5,900,067 A 5/1999 Jones
5,913,915 A 6/1999 McQuinn
5,917,425 A 6/1999 Crimmins et al.
5,939,974 A 8/1999 Heagle et al.
5,945,910 A 8/1999 Gorra
5,952,924 A 9/1999 Evans et al.
5,954,069 A 9/1999 Foster
5,966,753 A 10/1999 Gauthier et al.
5,977,913 A 11/1999 Christ
5,979,703 A 11/1999 Nystrom
5,987,105 A 11/1999 Jenkins et al.
6,012,041 A 1/2000 Brewer et al.
6,031,461 A 2/2000 Lynn
6,038,331 A 3/2000 Johnson
6,065,639 A 5/2000 Maddox et al.
6,125,482 A 10/2000 Foster
6,130,607 A 10/2000 McClanahan et al.
6,147,607 A 11/2000 Lynn
6,175,308 B1 1/2001 Tallman et al.
6,191,693 B1 2/2001 Sangsingkeow
6,211,788 B1 4/2001 Lynn et al.
6,213,424 B1 4/2001 Helfer-Grand
6,236,317 B1 5/2001 Cohen et al.
6,236,953 B1 5/2001 Segal
6,259,956 B1 7/2001 Myers et al.
6,278,372 B1 8/2001 Velasco, Jr. et al.
6,279,777 B1 8/2001 Goodin et al.
6,288,641 B1 9/2001 Casais
6,314,282 B1 11/2001 Weber et al.
6,331,964 B1 12/2001 Barone
6,347,724 B1 2/2002 Chen et al.
6,351,223 B1 2/2002 DeWeerd et al.
6,360,181 B1 3/2002 Gemmell et al.
6,368,420 B1 4/2002 Angevaare et al.
6,375,038 B1 4/2002 Daansen et al.
6,392,546 B1 5/2002 Smith
6,404,837 B1 6/2002 Thompson et al.
6,417,773 B1 7/2002 Vlahos et al.
6,426,701 B1 7/2002 Levy et al.
6,476,385 B1 11/2002 Albert
6,485,979 B1 11/2002 Kippenhan et al.
6,523,193 B2 2/2003 Saraya
6,524,390 B1 2/2003 Jones
6,577,240 B2 6/2003 Armstrong
6,611,207 B1 8/2003 Yuan et al.
6,681,003 B2 1/2004 Linder et al.
6,707,873 B2 3/2004 Thompson et al.
6,727,818 B1 4/2004 Wildman et al.
6,730,024 B2 5/2004 Freyre et al.
6,749,148 B2 6/2004 Helfer-Grand
6,759,959 B2 7/2004 Wildman
6,778,092 B2 8/2004 Braune
6,781,523 B2 8/2004 Matsui et al.
6,792,395 B2 9/2004 Roberts
6,799,085 B1 9/2004 Crisp, III
6,807,460 B2 10/2004 Black et al.
6,882,278 B2 4/2005 Winings et al.
6,882,315 B2 4/2005 Richley et al.
6,883,563 B2 4/2005 Smith
6,893,321 B1 5/2005 Buchanan et al.
6,897,780 B2 5/2005 Ulrich et al.
6,917,290 B2 7/2005 Land
6,919,567 B2 7/2005 Iwasawa
6,950,683 B2 9/2005 Hunt
6,956,498 B1 10/2005 Gauthier et al.
6,975,231 B2 12/2005 Lane et al.
6,977,588 B2 12/2005 Schotz et al.
7,015,816 B2 3/2006 Wildman et al.
7,023,341 B2 4/2006 Stilp
7,023,356 B2 4/2006 Burkhardt et al.
7,042,361 B2 5/2006 Kazdin et al.
7,056,050 B2 6/2006 Sacks
7,067,054 B2 6/2006 Fritze
7,069,188 B2 6/2006 Roberts
7,075,412 B1 7/2006 Reynolds et al.
7,099,781 B1 8/2006 Heidl et al.
7,099,856 B2 8/2006 Barangan et al.
7,117,374 B2 10/2006 Hill et al.
7,119,688 B2 10/2006 Wildman
7,119,692 B2 10/2006 Leiffort et al.
7,142,108 B2 11/2006 Diener et al.
7,154,397 B2 12/2006 Zerhusen et al.
7,157,045 B2 1/2007 McVey
7,187,287 B2 3/2007 Ryal
7,191,090 B1 3/2007 Cunningham
7,201,005 B2 4/2007 Voglewede et al.
7,202,780 B2 4/2007 Teller
7,236,097 B1 6/2007 Cunningham
7,242,306 B2 7/2007 Wildman et al.
7,242,307 B1 * 7/2007 LeBlond ..... G08B 21/245 340/3.1
7,248,933 B2 7/2007 Wildman
7,265,673 B2 9/2007 Teller
7,266,347 B2 9/2007 Gross
7,267,531 B2 9/2007 Anderson et al.
7,271,728 B2 9/2007 Taylor et al.
7,272,537 B2 9/2007 Mogadam
7,286,057 B2 10/2007 Bolling
7,292,914 B2 11/2007 Jungmann et al.
7,293,645 B2 11/2007 Harper et al.
7,315,245 B2 1/2008 Lynn et al.
7,330,108 B2 2/2008 Thomas
7,372,367 B2 5/2008 Lane et al.
7,375,640 B1 5/2008 Plost
7,400,264 B2 7/2008 Boaz
7,408,470 B2 8/2008 Wildman et al.
7,411,511 B2 8/2008 Kennish et al.
7,423,533 B1 9/2008 LeBlond et al.
7,425,900 B2 9/2008 Lynn et al.
7,440,620 B1 10/2008 Aartsen
7,443,302 B2 10/2008 Reeder et al.
7,443,305 B2 10/2008 Verdiramo
RE40,588 E 11/2008 Ostendorf et al.
7,450,472 B2 11/2008 Guyvarch

(56) References Cited

U.S. PATENT DOCUMENTS 7,457,869 B2 11/2008 Kernan
7,474,215 B2 1/2009 Scott et al.
7,477,148 B2 1/2009 Lynn et al.
7,482,936 B2 1/2009 Bolling
7,486,193 B2 2/2009 Elwell
7,487,538 B2 2/2009 Mok
7,490,045 B1 2/2009 Flores et al.
7,496,479 B2 2/2009 Garcia et al.
7,538,680 B2 5/2009 Scott et al.
7,551,092 B1 6/2009 Henry
7,597,122 B1 10/2009 Smith
7,600,137 B2 10/2009 Trappeniers et al.
7,605,704 B2 10/2009 Munro et al.
7,611,030 B2 11/2009 Reynolds et al.
7,616,122 B2 11/2009 Bolling
7,718,395 B2 5/2010 Carling
7,780,453 B2 8/2010 Carling
7,785,109 B2 8/2010 Carling
7,812,730 B2 10/2010 Wildman et al.
7,978,564 B2 7/2011 De La Huerga
7,982,619 B2 7/2011 Bolling
8,020,733 B2 9/2011 Snodgrass
8,026,821 B2 9/2011 Reeder et al.
8,056,768 B2 11/2011 Snodgrass
8,085,155 B2 12/2011 Prodanovich et al.
D654,743 S 2/2012 Rospierski
8,212,653 B1 7/2012 Goldstein et al.
8,237,558 B2 8/2012 Seyed Momen et al.
8,240,517 B1 8/2012 Stob et al.
8,258,965 B2 9/2012 Reeder et al.
8,264,343 B2 9/2012 Snodgrass
8,342,365 B2 1/2013 Snodgrass
8,344,893 B1 1/2013 Drammeh
8,350,706 B2 1/2013 Wegelin et al.
8,368,544 B2 2/2013 Wildman et al.
8,395,515 B2 3/2013 Tokhtuev
8,400,309 B2 3/2013 Glenn et al.
8,482,406 B2 7/2013 Snodgrass
8,502,680 B2 8/2013 Tokhtuev et al.
8,502,681 B2 8/2013 Bolling et al.
8,525,666 B2 9/2013 Melker et al.
8,558,701 B2 10/2013 Wegelin et al.
8,564,431 B2 10/2013 Snodgrass
D693,140 S 11/2013 Rospierski
8,587,437 B2 11/2013 Kyle et al.
8,598,996 B2 12/2013 Wildman et al.
8,633,806 B2 1/2014 Amir
8,633,816 B2 1/2014 Snodgrass et al.
8,646,656 B2 2/2014 Johnson
8,674,840 B2 3/2014 Snodgrass
8,783,511 B2 7/2014 Snodgrass
8,823,525 B2 9/2014 Cartner et al.
8,847,752 B2 9/2014 Wegelin et al.
8,872,665 B2 10/2014 Snodgrass
8,963,721 B2 2/2015 Harris et al.
8,963,723 B2 2/2015 Snodgrass
9,000,930 B2 4/2015 Pelland et al.
9,047,755 B2 6/2015 Bonner
9,117,361 B1 8/2015 Hennigan et al.
9,159,216 B2 10/2015 Limbert et al.
9,239,361 B2 1/2016 Long
9,311,809 B2 4/2016 Diaz
9,349,274 B2 5/2016 Wegelin et al.
9,524,632 B2 12/2016 Moore
9,633,543 B2 4/2017 Wegelin et al.
9,633,544 B2 4/2017 Wegelin et al.
9,633,545 B2 4/2017 Wegelin et al.
2001/0039501 A1 11/2001 Crevel et al.
2001/0047214 A1 11/2001 Cocking et al.
2001/0053939 A1 12/2001 Crevel et al.
2001/0054038 A1 12/2001 Crevel et al.
2002/0000449 A1 1/2002 Armstrong
2002/0019709 A1 2/2002 Segal
2002/0050006 A1 5/2002 Saraya
2002/0103671 A1 8/2002 Pederson et al.
2002/0107744 A1 8/2002 Rosenberg et al.
2002/0132343 A1 9/2002 Lum
2002/0135486 A1 9/2002 Brohagen et al.
2002/0145523 A1 10/2002 Robaey
2002/0175182 A1 11/2002 Matthews
2002/0183979 A1 12/2002 Wildman
2003/0030562 A1 2/2003 Lane et al.
2003/0065536 A1 4/2003 Hansen et al.
2003/0074222 A1 4/2003 Rosow et al.
2003/0182180 A1 9/2003 Zarrow
2004/0001009 A1 1/2004 Winings et al.
2004/0015269 A1 1/2004 Jungmann et al.
2004/0028608 A1 2/2004 Saul et al.
2004/0049369 A1 3/2004 Konicek et al.
2004/0075347 A1 4/2004 Biskup, Sr. et al.
2004/0088076 A1 5/2004 Gardner, Jr.
2004/0090333 A1 5/2004 Wildman et al.
2004/0148196 A1 7/2004 Kalies
2004/0150527 A1 8/2004 Harper et al.
2004/0162850 A1 8/2004 Sanville et al.
2005/0086341 A1 4/2005 Enga et al.
2005/0102167 A1 5/2005 Kapoor
2005/0134466 A1 6/2005 Tirkel
2005/0149341 A1 7/2005 Eguchi et al.
2005/0171634 A1 8/2005 York et al.
2005/0222889 A1 10/2005 Lai et al.
2006/0067545 A1 3/2006 Lewis et al.
2006/0067546 A1 3/2006 Lewis et al.
2006/0071799 A1 4/2006 Verdiramo
2006/0104245 A1 5/2006 Narayanaswami et al.
2006/0132316 A1 6/2006 Wildman et al.
2006/0139449 A1 6/2006 Cheng et al.
2006/0140703 A1 6/2006 Sacks
2006/0154642 A1 7/2006 Scannell, Jr.
2006/0156415 A1 7/2006 Rubinstein et al.
2006/0223731 A1 10/2006 Carling
2006/0229821 A1 10/2006 Brossette et al.
2006/0272361 A1 12/2006 Snodgrass
2006/0273915 A1 12/2006 Snodgrass
2007/0008146 A1 1/2007 Taylor et al.
2007/0008147 A1 1/2007 Bolling
2007/0008149 A1 1/2007 Bolling
2007/0016466 A1 1/2007 Taylor
2007/0020212 A1 1/2007 Bernal et al.
2007/0029962 A1 2/2007 Saeki
2007/0044819 A1 3/2007 Chan et al.
2007/0055483 A1 3/2007 Lee et al.
2007/0056091 A1 3/2007 Bolton et al.
2007/0069884 A1 3/2007 Waxman
2007/0096930 A1 5/2007 Cardoso
2007/0135866 A1 6/2007 Baker et al.
2007/0182581 A1 8/2007 Elwell
2007/0198067 A1 8/2007 Van den Heuvel et al.
2007/0205861 A1 9/2007 Nair et al.
2007/0213877 A1 9/2007 Hart et al.
2007/0222599 A1 9/2007 Coveley et al.
2007/0229288 A1 10/2007 Ogrin et al.
2007/0247316 A1 10/2007 Wildman et al.
2007/0257803 A1 11/2007 Munro et al.
2007/0285277 A1 12/2007 Scott et al.
2007/0290865 A1 12/2007 Lynn et al.
2008/0001763 A1 1/2008 Raja et al.
2008/0019489 A1 1/2008 Lynn
2008/0019490 A1 1/2008 Lynn
2008/0046278 A1 2/2008 Sanville et al.
2008/0084315 A1 4/2008 Pittz
2008/0087719 A1 4/2008 Sahud
2008/0100441 A1 5/2008 Prodanovich et al.
2008/0103636 A1 5/2008 Glenn et al.
2008/0131332 A1 6/2008 Nguyen et al.
2008/0177155 A1 7/2008 Hansen et al.
2008/0185540 A1 8/2008 Turner et al.
2008/0189142 A1 8/2008 Brown et al.
2008/0193631 A1 8/2008 Kanamori et al.
2008/0246599 A1 10/2008 Hufton et al.
2008/0266113 A1 10/2008 Kennish et al.
2008/0267408 A1 10/2008 Hsieh
2008/0280380 A1 11/2008 Dietz et al.
2008/0290112 A1 11/2008 Lynn

(56) References Cited

U.S. PATENT DOCUMENTS

2008/0303658 A1 12/2008 Melker et al.
2009/0002644 A1 1/2009 Christensen et al.
2009/0019552 A1 1/2009 McLaughlin et al.
2009/0030721 A1 1/2009 Garcia et al.
2009/0049610 A1 2/2009 Heimbrock et al.
2009/0051545 A1 2/2009 Koblasz
2009/0068116 A1 3/2009 Arndt
2009/0084407 A1 4/2009 Glenn et al.
2009/0091458 A1 4/2009 Deutsch
2009/0102681 A1 4/2009 Brennan, Jr. et al.
2009/0112360 A1 4/2009 Berg
2009/0119142 A1 5/2009 Yenni et al.
2009/0127282 A1 5/2009 Reynolds et al.
2009/0138303 A1 5/2009 Seshadri
2009/0195385 A1 8/2009 Huang et al.
2009/0204256 A1 8/2009 Wegelin
2009/0219131 A1 9/2009 Barnett et al.
2009/0219172 A1 9/2009 Wilbrod
2009/0224907 A1 9/2009 Sinha et al.
2009/0224924 A1 9/2009 Thorp
2009/0266842 A1 10/2009 Snodgrass
2009/0267776 A1 10/2009 Glenn et al.
2009/0272405 A1 11/2009 Barnhill et al.
2009/0273477 A1 11/2009 Barnhill
2009/0276239 A1 11/2009 Swart et al.
2009/0299787 A1 12/2009 Barnhill
2009/0301523 A1 12/2009 Barnhill et al.
2010/0050314 A1 3/2010 Oleyar et al.
2010/0094581 A1 4/2010 Cagle
2010/0097224 A1 4/2010 Prodanovich et al.
2010/0117836 A1 5/2010 Momen et al.
2010/0125362 A1 5/2010 Canora et al.
2010/0153374 A1 6/2010 LeBlond et al.
2010/0164728 A1 7/2010 Plost
2010/0188228 A1 7/2010 Hyland
2010/0207767 A1 8/2010 Verdiramo
2010/0231385 A1 9/2010 Melker et al.
2010/0233020 A1 9/2010 Klaassen et al.
2010/0274640 A1 10/2010 Morey et al.
2010/0315243 A1 12/2010 Tokhtuev et al.
2010/0315244 A1* 12/2010 Tokhtuev ..... G06Q 10/00 340/603
2010/0321180 A1 12/2010 Dempsey et al.
2010/0326472 A1 12/2010 Glenn et al.
2010/0328076 A1 12/2010 Kyle et al.
2010/0332022 A1 12/2010 Wegelin et al.
2011/0030730 A1 2/2011 Lynn
2011/0046921 A1 2/2011 Sahud
2011/0057799 A1 3/2011 Taneff et al.
2011/0063106 A1* 3/2011 Snodgrass ..... G06F 19/327 340/539.16
2011/0088809 A1 4/2011 Lin
2011/0093313 A1 4/2011 LeBlond et al.
2011/0121974 A1 5/2011 Tenarvitz et al.
2011/0169645 A1 7/2011 Cartner et al.
2011/0169646 A1 7/2011 Raichman
2011/0193703 A1 8/2011 Payton et al.
2011/0197921 A1 8/2011 Rubin et al.
2011/0207402 A1 8/2011 Perkins et al.
2011/0234598 A1 9/2011 Scarola et al.
2011/0273298 A1 11/2011 Snodgrass et al.
2011/0291840 A1 12/2011 Pelland et al.
2011/0316701 A1 12/2011 Alper et al.
2011/0316703 A1 12/2011 Butler et al.
2011/0320134 A1 12/2011 Butler et al.
2012/0055986 A1 3/2012 Sahud
2012/0062382 A1 3/2012 Taneff
2012/0073604 A1 3/2012 Barnhill et al.
2012/0112906 A1 5/2012 Borke et al.
2012/0112914 A1 5/2012 Wegelin et al.
2012/0140054 A1 6/2012 Chen et al.
2012/0158419 A1 6/2012 Nuthi
2012/0187146 A1 7/2012 Chopra
2012/0214879 A1 8/2012 Arndt
2012/0245729 A1 9/2012 Wegelin et al.
2012/0245951 A1 9/2012 Gips et al.
2012/0256742 A1 10/2012 Snodgrass et al.
2012/0310664 A1 12/2012 Long et al.
2012/0329438 A1 12/2012 Snodgrass
2013/0045685 A1 2/2013 Kiani
2013/0048718 A1 2/2013 Tessier
2013/0075346 A1 3/2013 Rumberger et al.
2013/0076514 A1 3/2013 Wegelin et al.
2013/0091631 A1 4/2013 Hayes et al.
2013/0113931 A1 5/2013 Alper
2013/0120120 A1 5/2013 Long et al.
2013/0229276 A1 9/2013 Hunter
2013/0234855 A1 9/2013 Knighton
2013/0257615 A1 10/2013 Iseri et al.
2013/0261795 A1 10/2013 Long et al.
2013/0264355 A1 10/2013 Jodoin
2013/0290016 A1 10/2013 Alper et al.
2013/0306105 A1 11/2013 Battah
2013/0333184 A1 12/2013 Couture et al.
2013/0342349 A1 12/2013 Cruz
2014/0009292 A1 1/2014 Long et al.
2014/0015670 A1 1/2014 Wegelin et al.
2014/0070950 A1 3/2014 Snodgrass
2014/0081653 A1 3/2014 Davis et al.
2014/0214449 A1 7/2014 Long et al.
2014/0253334 A1 9/2014 Hanlin et al.
2014/0279603 A1 9/2014 Ortiz et al.
2014/0361898 A1 12/2014 Wegelin et al.
2015/0022361 A1 1/2015 Gaisser et al.
2015/0035678 A1 2/2015 Long
2015/0048940 A1 2/2015 Keown et al.
2015/0127365 A1 5/2015 Rizvi et al.
2015/0134354 A1 5/2015 Alper et al.
2015/0179047 A1 6/2015 Wallace et al.
2015/0194043 A1 7/2015 Dunn et al.
2015/0199883 A1 7/2015 Hartley et al.
2015/0313422 A1 11/2015 Ophardt et al.
2016/0093195 A1 3/2016 Ophardt

FOREIGN PATENT DOCUMENTS

CA 2780411 A1 12/2013
CN 101592510 A 12/2009
CN 201974318 U 9/2011
CN 202677403 U 1/2013
DE 69708606 T2 8/2002
DE 69917795 T2 7/2005
DE 19882120 A2 10/2010
DE 102012105365 A1 12/2013
DK 2015665 T3 11/2009
EP 0921506 A1 6/1999
EP 1121500 10/1999
EP 1245016 10/2000
EP 1099400 A2 5/2001
EP 1201172 A2 5/2002
EP 1791077 A2 5/2004
EP 1390204 B1 12/2004
EP 1034132 B1 8/2005
EP 1794727 9/2005
EP 1483728 B1 10/2006
EP 1872802 A1 1/2008
EP 1872892 A1 1/2008
EP 1913892 A2 4/2008
EP 2223642 A2 9/2010
EP 2511889 A2 10/2010
EP 2509017 A2 10/2012
EP 2637540 A2 9/2013
FR 2872315 A1 12/2005
FR 2997779 A1 5/2014
GB 2137749 A 10/1984
GB 2217013 A 10/1989
GB 2299405 A 2/1996
GB 2324397 A 10/1998
GB 2337327 A 11/1999
GB 2340647 A 2/2000
GB 2394654 A 5/2004
GB 2417810 A 3/2006
GB 2417811 A 3/2006
GB 2425388 A 10/2006

(56) References Cited

FOREIGN PATENT DOCUMENTS

| | | | |
|---|---|---|---|
| GB | 2446871 | | 8/2007 |
| GB | 2437555 | A | 10/2007 |
| GB | 2439306 | A | 12/2007 |
| GB | 2439457 | | 12/2007 |
| GB | 2452189 | A | 2/2009 |
| GB | 2474317 | A | 4/2011 |
| GB | 2486767 | A | 6/2012 |
| JP | H01219439 | A | 9/1989 |
| JP | 10309540 | A | 11/1998 |
| JP | 2002197559 | | 7/2002 |
| JP | 2003105819 | A | 4/2003 |
| JP | 2003122823 | A | 4/2003 |
| JP | 2006132277 | A | 5/2005 |
| JP | 2005218999 | A | 8/2005 |
| JP | 2006198318 | A | 8/2006 |
| JP | 2009282442 | A | 12/2009 |
| JP | 2013017631 | A | 1/2013 |
| JP | 2013180046 | A | 9/2013 |
| JP | 2013187557 | A | 9/2013 |
| PT | 882280 | E | 5/2002 |
| WO | WO/92/13327 | A1 | 8/1992 |
| WO | WO/97/31350 | A1 | 8/1997 |
| WO | WO/98/09261 | A1 | 3/1998 |
| WO | WO/98/36258 | A2 | 8/1998 |
| WO | WO/9930299 | A1 | 6/1999 |
| WO | WO/00/22260 | A1 | 4/2000 |
| WO | WO/01/33529 | A1 | 5/2001 |
| WO | WO/02/21475 | A1 | 3/2002 |
| WO | WO/02/94073 | A1 | 11/2002 |
| WO | WO/03/079278 | A1 | 9/2003 |
| WO | WO/03/082351 | A2 | 10/2003 |
| WO | WO/2005/055793 | A2 | 6/2005 |
| WO | WO/2005/055793 | A3 | 6/2005 |
| WO | WO/2005/094711 | A2 | 10/2005 |
| WO | WO/2006/036687 | A2 | 4/2006 |
| WO | WO/2006/135922 | A3 | 12/2006 |
| WO | WO/2007/001866 | A2 | 1/2007 |
| WO | WO/2007/090470 | A1 | 8/2007 |
| WO | WO 2007/127495 | A2 | 11/2007 |
| WO | WO/2007/129289 | A1 | 11/2007 |
| WO | WO/2007/133960 | A2 | 11/2007 |
| WO | WO/2008/088424 | A1 | 7/2008 |
| WO | WO 2008/118143 | A2 | 10/2008 |
| WO | WO 2008/119158 | A1 | 10/2008 |
| WO | WO/2008/133495 | A1 | 11/2008 |
| WO | WO 2009/087046 | A1 | 7/2009 |
| WO | WO 2009/097096 | A1 | 8/2009 |
| WO | WO/2009/134242 | A1 | 11/2009 |
| WO | WO/2010/026581 | A2 | 3/2010 |
| WO | WO 2010/028320 | A1 | 3/2010 |
| WO | WO 2010/034125 | A1 | 4/2010 |
| WO | WO 2010/070072 | A1 | 6/2010 |
| WO | WO 2010/093349 | A1 | 8/2010 |
| WO | WO 2010/099488 | A1 | 9/2010 |
| WO | WO/2010/101929 | A2 | 9/2010 |
| WO | WO 2010/104564 | A2 | 9/2010 |
| WO | WO 2010/118242 | A1 | 10/2010 |
| WO | WO 2012/148771 | A2 | 11/2010 |
| WO | WO 2010/143091 | A2 | 12/2010 |
| WO | WO 2010/143092 | A2 | 12/2010 |
| WO | WO 2011/031774 | A1 | 3/2011 |
| WO | WO 2011/038173 | A1 | 3/2011 |
| WO | WO 2011/058293 | A1 | 5/2011 |
| WO | WO2011/062658 | A1 | 5/2011 |
| WO | WO 2011/072837 | A1 | 6/2011 |
| WO | WO 2011/085292 | A2 | 7/2011 |
| WO | WO 2011/119695 | A2 | 9/2011 |
| WO | WO/2012/064515 | A2 | 5/2012 |
| WO | WO 2012/178045 | A2 | 12/2012 |
| WO | WO/2013/025889 | A1 | 2/2013 |
| WO | WO/2013/025956 | A1 | 2/2013 |
| WO | WO 2013/033243 | A2 | 3/2013 |
| WO | WO/2013/049357 | A2 | 4/2013 |
| WO | WO 2013/049462 | A1 | 4/2013 |
| WO | WO 2013/055616 | A2 | 4/2013 |
| WO | WO 2013/058821 | A1 | 4/2013 |
| WO | WO 2013/063690 | A1 | 5/2013 |
| WO | WO 2013/070888 | A1 | 5/2013 |
| WO | WO 2013/074660 | A1 | 5/2013 |
| WO | WO 2013/140253 | A1 | 9/2013 |
| WO | WO 2013/165585 | A1 | 11/2013 |
| WO | WO 2014/027030 | A2 | 2/2014 |
| WO | WO/2014/037938 | A2 | 3/2014 |
| WO | WO/2014/046645 | A1 | 3/2014 |
| WO | WO 2014/060726 | A1 | 4/2014 |
| WO | WO 2014/205283 | A1 | 12/2014 |
| WO | WO/2015/061718 | A1 | 4/2015 |

OTHER PUBLICATIONS

Anonymous et al., "Hand Hygiene," Progressive Grocer, vol. 76, No. 8, Aug. 1997, pp. 111-112.

Bourn, Auditor General for Wales, "The Management and Delivery of Hospital Cleaning Services in Wales," National Audit Office Wales, 39 pp., May 23, 2003.

Dancer, "How do we Assess Hospital Cleaning? A Proposal for Microbiological Standards for Surface Hygiene in Hospitals" Journal of Hospital Infection, vol. 56, Sep. 2003, pp. 10-15.

Diller et al., "Estimation of hand hygiene opportunities on an adult medical ward using 24-hour camera surveillance: Validation of the HOW2 Benchmark Study," American Journal of Infection Control, vol. 42, 2014 (Applicant points out, in accordance with MPEP 609.04(a), that the year of publication, 2014, is sufficiently earlier than the effective U.S. filing date, 2017, so that the particular month of publication is not in issue.) pp. 602-607.

Dix et al., "Environmental Surface Cleaning: First Defense Against Infectious Agents," Infection Control Today Magazine, 6 pp., Dec. 1, 2005.

Elliott, "Determining Three Metrics for Cleaning Satisfaction," found at http://www.facilitiesnet.com/fn/article.asp?id-7698, equipmentrentaltools/article/Determining-Three-Metrics-for -Cleaning-Satisfaction—7698#, Nov. 2007, 2 pp.

Evaluating Municipal Services: Scorecard Cleanliness Program Prospectus, New York, found at http://www.worldsweeper.com/Street/Profiles/NYCScorecard.pdf, archived Jan. 5, 2009, 16 pp.

Exner et al., "Household Cleaning and Surface Disinfection: New Insights and Strategies," Journal of Hospital Infection, vol. 56, 2008, pp. s70-s75.

Florida Department of Health, "Guidelines for Control of Antibiotic Resistant Organisms," Dec. 20, 1999, 34 pp.

Griffith et al., "An Evaluation of Hospital Cleaning Regimes and Standards," J. Hosp. Infect., vol. 45, pp. 19-28, 2000, accepted Dec. 23, 1999.

Griffith et al., "The Effectiveness of Existing and Modified Cleaning Regimens in a Welsh Hospital," Journal of Hospital Infection, vol. 66, Jul. 26, 2007, pp. 352-359.

Griffith, "Nosocomial infection: Are there lessons from the food industry?" The Biomedical Scientist, pp. 697-699, Aug. 2006.

Hamilton et al., "Hand Hygiene," Wild Iris Medical Education, Inc., 2014, (Applicant points out, in accordance with MPEP 609.04(a), that the year of publication, 2014, is sufficiently earlier than the effective U.S. filing date, 2017, so that the particular month of publication is not in issue.) 24 pp.

"Hand Washing, Cleaning, Disinfection and Sterilization in Health Care," Infection Control Guidelines, Canada Communicable Disease Report, vol. 24S8, Dec. 1998, 66 pp.

"Measuring Hand Hygiene Adherence: Overcoming the Challenges," The Joint Commission et al., 2009 (Applicant points out, in accordance with MPEP 609.04(a), that the year of publication, 2009, is sufficiently earlier than the effective U.S. filing date, 2017, so that the particular month of publication is not in issue.) 234 pp.

Larson, "APIC Guideline for Hand Washing and Hand Antisepsis in Health-Care Settings*," APIC Guidelines Committee, 1995, (Applicant points out, in accordance with MPEP 609.04(a), that the year of publication, 1995, is sufficiently earlier than the effective U.S. filing date, 2017, so that the particular month of publication is not in issue.), Am J Infect Control, 23:251, 18 pp.

(56) References Cited

OTHER PUBLICATIONS

Larson et al., "A Multifaceted Approach to Changing Handwashing Behavior," American Journal of Infection Control, vol. 25, Feb. 1997, pp. 3-10.
Lewis et al., "A Modified ATP Benchmark for Evaluating the Cleaning of Some Hospital Environmental Surfaces," Journal of Hospital Infection, vol. 69, May 12, 2008, pp. 156-163.
Malik et al., "Use of Audit Tools to Evaluate the Efficacy of Cleaning Systems in Hospitals," Am. J. Infect. Control, vol. 31, No. 3, p. 181-187, May 2003.
Mallow General Hospital, "Hygiene Services Assessment Scheme, Assessment Report," 38 pp., Oct. 2007.
Mangram et al., "Guideline for Prevention of Surgical Site Infection, 1999," Infection Control and Hospital Epidemiology, vol. 20, No. 4, Apr. 1999, pp. 247-278.
Meengs et al., "Hand Washing Frequency in an Emergency Department," Annals of Emergency Medicine, vol. 23, No. 6, Jun. 1994, pp. 1307-1312.
Mills et al., "Guidelines for Working with Rodents Potentially Infected with Hantavirus," Journal of Mammalogy, vol. 76, No. 3, Aug. 1995, pp. 716-722.
CDC, HICPAC, "Guideline for Hand Hygiene in Health-Care Settings," Morbidity and Mortality Weekly Report, Recommendations and Reports, (MMWR)vol. 51, No. RR-16, Oct. 25, 2002, 56 pp.
Munro et al., "Treating Exposure to Chemical Warfare Agents: Implications for Health Care Providers and Community Emergency Planning," Environmental Health Perspectives, vol. 89, 1990 (Applicant points out, in accordance with MPEP 609.04(a), that the year of publication, 1990, is sufficiently earlier than the effective U.S. filing date, 2017, so that the particular month of publication is not in issue.) pp. 205-2015.
"Net/Tech to Unveil Patented Hygiene Guard Hand-Washing Monitoring System at the National Restaurant Show," BusinessWire, Apr. 3, 1997, 3 pp.
Ophardt, Hygiene-Technik GmbH+ Co. KG, "Making the World a More Hygienic Place", Hygiene Compliance Solutions, 2009, 1 page.
Pittet et al., "Compliance with Handwashing in a Teaching Hospital," Annals of Internal Medicine, vol. 130, No. 2, Jan. 19, 1999, pp. 126-130.
Prosecution History from U.S. Appl No. 12/787,064, dated Dec. 6, 2012 through Apr. 8, 2013, 20 pp.
Prosecution History from U.S. Appl. No. 12/787,097, dated Jun. 4, 2012 through Nov. 7, 2012, 21 pp.
Quattrin, Md. et al., "Application of Hazard Analysis Critical Control Points to Control Surgical Site Infections in Hip and Knee Arthroplasty," Orthopedics 31:132, 6 pp., 2008, SLACK Incorporated.
SaferCorp, LLC, "SaferCorp Life Advantage Solutions presents SaferHands™ Hospital Automated Hand Hygiene Monitoring System", retrieved electronically from http://www.guardianics.com/ on Dec. 15, 2010, 14 pp.
SaferCorp, LLC, Guardian™ Automated Infection Control Systems (GAICS), Feb. 6, 2010, 4 pp.
Sax et al., "My five moments for hand hygiene: a user-centered design approach to understand, train, monitor and report hand hygiene," Journal of Hospital Infection, vol. 67, Aug. 27, 2007, pp. 9-21.
Semmelweis, "The Etiology, Concept, and Prophylaxis of Childbed Fever," The University of Wisconsin Press, 1983 (Applicant points out, in accordance with MPEP 609.04(a), that the year of publication, 1983, is sufficiently earlier than the effective U.S. filing date, 2017, so that the particular month of publication is not in issue.) 14 pp.
Steed et al., "Hospital Hand Hygiene Opportunities: Where and When (HOW2)? The HOW2 Benchmark Study," American Journal of Infection Control, vol. 39, Feb. 2011, 8 pp.
Sturman et al., "Cornell University Hospitality Report: A New Method for Measuring Housekeeping Performance Consistency," CHR Reports, vol. 6, No. 11, Sep. 2006, 15 pp.
Swoboda et al., "Electronic Monitoring and Voice Prompts Improve Hand Hygiene and Decrease Nosocomial Infections in an Intermediate Care Unit," Crit Care Med, vol. 32, No. 2, 2004 (Applicant points out, in accordance with MPEP 609.04(a), that the year of publication, 2004, is sufficiently earlier than the effective U.S. filing date, Jan. 13, 2017, so that the particular month of publication is not in issue.) pp. 358-363.
Taylor, An Evaluation of Handwashing Techniques-1, Nursing Times, vol. 74, Jan. 12, 1978, pp. 54-55.
Thompson et al., "Handwashing and Glove Use in a Long-Term-Care Facility," Infection Control and Hospital Epidemiology, vol. 18, No. 2, Feb. 1997, pp. 97-103.
Tibballs et al., "Teaching Hospital Medical Staff to Handwash," The Medical Journal of Australia, vol. 164, No. 7, Apr. 1, 1996, pp. 395-398.
Van Ryzin et al., "Measuring Street Cleanliness: A Comparison of New York City's Scorecard and Results from a Citizen Survey," Public Administration Review 68(2), Mar./Apr. 2008, pp. 295-303.
Yoshikura, "Workflow from Clean to Dirty, HACCP and Inclusiveness Principles in Effective Implementation of Hospital Infection Control," Jpn. J. Infect. Dis. 53, Jun. 6, 2000, 2 pp.
Watanakunakorn et al., "An Observational Study of Hand Washing and Infection Control Practices by Healhcare Workers," Infection Control and Hospital Epidemiolgy, vol. 19, No. 11, Nov. 1998, pp. 858-860.
"WHO Guidelines on Hand Hygiene in Health Care (Advanced Draft)," World Health Organization, Apr. 2006, 216 pp.
"WHO Guidelines on Hand Hygiene in Health Care," World Health Organization, 2009 (Applicant points out, in accorace with MPEP 609.04(a), that the year of publication, 2009, is sufficiently earlier than the effective U.S. filing date, 2017, so that the particular month of publication is not in issue.) 270 pp.
"Evidence of hand hygiene to reduce transmission and infections by multi-drug resistant organisms in health-care settings," World Health Organization, Jan. 5, 2014, 7 pp.
Zuhlsdorf et al., "Cleaning Efficacy of Nine Different Cleaners in a Washer-Disinfector Designed for Flexible Endoscopes," Journal of Hospital Infection, vol. 52, Oct. 9, 2002, pp. 206-211.
"Don't Get Caught Dirty Handed," ASM's Microbes Afterhours, Sep. 6, 2009, 11 pp.
"America's Dirty Little Secret: Second Handwashing Survey Reveals Americans Still Don't Get It," American Society for Microbiology, Sep. 19, 2000, 3 pp.
Garner et al., "Guideline for Handwashing and Hospital Environmental Control," CDC Prevention Guidelines, Jan. 1, 1985, 10 pp.
Garner, "Guidelines for Isolation Precautions in Hospitals," Hospital Infection Control Advisory Committee, Jan. 1, 1996, 39 pp.
Hicpac, "Recommendations for Preventing the Spread of Vancomycin Resistance," Morbidity and CDC Mortality Weekly Report, Recommendations and Reports, vol. 44, No. RR-12, 1-13, Sep. 22, 1995, 16 pp.
"Dr. Semmelweiss Was Right: Washing Hands Prevents Infection," Water Quality and Health Council, retrieved from www.waterandhealth.org/newsletter/new/4/12/2017/right.htm, Feb. 2017, 2 pp.
U.S. Appl. No. 61/437,466 by David L. Snodgrass, filed Jan. 28, 2011.
U.S. Appl. No. 61/486,491 by David L. Snodgrass, filed May 16, 2011.
"Bentley WiNET Tag User Guide—FAS1503, DOC1036," UltraClenz, Jan. 25, 2011, 12 pp.
"ProGiene System Description for UL and CE Mark Approval," UltraClenz, Feb. 8, 2002, 5 pp.
Green, "Hand hygiene in 2015: 7 Findings," retrieved from http://www.beckershospitalreview.com/quality!hand-hygiene-i n-2015-7-findings.htm l?tm pl=component&print= 1 &layout=default &page=, Nov. 12, 2015, 1 pp.
"3M and Patient Care Technology Systems Collaborate on State of-the-Art Automated Hand Hygiene Solution to Improve Compli-

(56) References Cited

OTHER PUBLICATIONS ance," retrieved from http://news.3m.com/pt/press-release/company/3m-and-patient-care-technology, on Apr. 13, 2017, 2 pp.
Sahud et al., "An Electronic Hand Hygiene Surveillance Device: A Pilot Study Exploring Surrogate Makers for Hand Hygiene Compliance," Infection Control and Hospital Epidemiology, vol. 31, No. 6, Jun. 2010, 6 pp.
Swedberg, "RFID-based Hand-Hygiene System Prevents Health-Care Acquired Infections," RFID Journal, Jun. 10, 2010, 2 pp.
"Patient Safeguard System Healthcare Worker Badge User's Guide," DOC1046 Revision 8, UltraClenz, Mar. 14, 2012, 21 pp.
Levchenko et al., "Embedded System for Hygiene Compliance Monitoring," IEEE Transactions on Automation Science and Engineering, vol. 7, No. 3, Jul. 2010, 4 pp.
Tsai et al., "iMAT: Intelligent Medication Administration Tools," Aug. 2010, 8 pp.

* cited by examiner

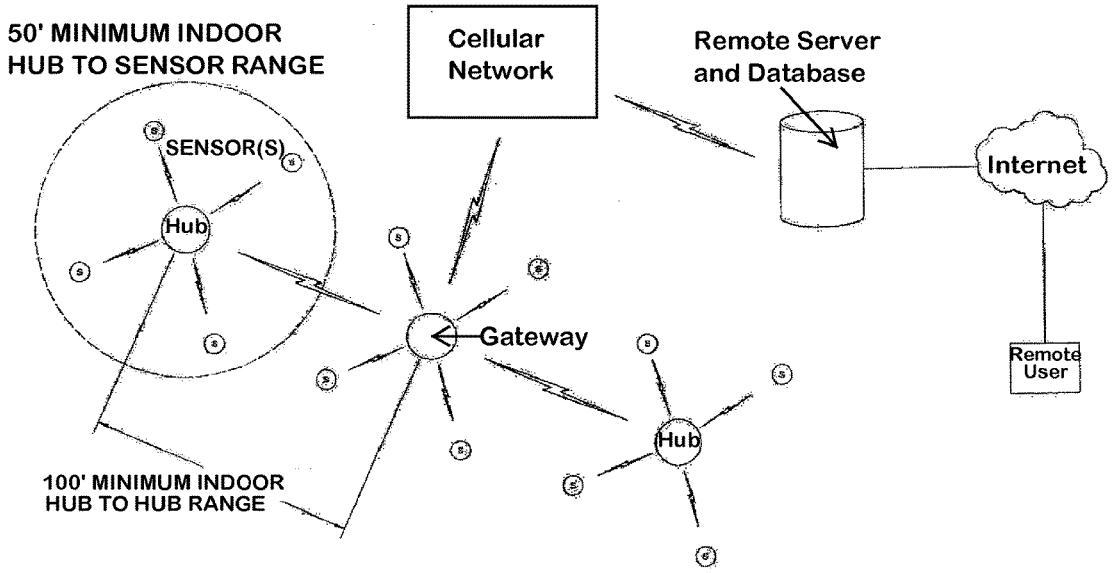
50' MINIMUM INDOOR
HUB TO SENSOR RANGE
Cellular
Network
Remote Server
and Database
SENSOR(S)
Hub
Internet
Gateway
Remote
User
Hub
100' MINIMUM INDOOR
HUB TO HUB RANGE

WIRELESS COMMUNICATION FOR DISPENSER BEACONS

CROSS-REFERENCE TO RELATED APPLICATIONS

This application is a continuation of U.S. application Ser. No. 14/164,930, filed on Jan. 27, 2014, entitled, "WIRELESS COMMUNICATION FOR DISPENSER BEACONS" which claims the benefit of U.S. Provisional Application Ser. No. 61/756,791 filed Jan. 25, 2013, which is incorporated by reference herein. This application also incorporates by reference U.S. Ser. No. 61/437,466 filed Jan. 28, 2011, U.S. Ser. No. 61/486,491 filed May 16, 2011, U.S. Ser. No. 13/215,823 filed Aug. 23, 2011 and U.S. Ser. No. 13/612,095 filed Sep. 12, 2012.

BACKGROUND OF THE INVENTION

The present invention relates to hygiene dispenser systems and for monitoring hygiene compliance data by users of such systems, and more particularly to a communication system for wirelessly transmitting dispenser status data from the dispensers to a central station, including a cellular telephone network.

Hygiene compliance systems collect hygiene compliance data collected by sensors at a hygiene dispenser system. The data is typically stored locally at the hygiene dispenser. The data may be transmitted over a communications line which may be a hard-wire, such as a half-duplex RS-485 network to a central location, which may receive data from a plurality of hygiene dispensers. The data may be analyzed at the central location, and hygiene compliance reports may be generated with a view towards insuring compliance with hygiene protocols and regulations, and to improve compliance when compliance has been found to be lacking, not optimal, or in need of improvement in some way.

SUMMARY OF THE INVENTION

In some hygiene compliance systems, the hygiene data is transferred over a local network at a customer site to a monitoring station which collects and analyses the information.

Sometimes a different entity, other than the customer, collects and analyzes the data, but the data is still transferred over the customer-owned or -operated network. This may result in security issues, as the different entity doing the monitoring, should not, from the customer's perspective, have access to the entire network which includes data other than hygiene monitoring data. Also, the different entity doing the monitoring may be monitoring with a proprietary data protocol or other proprietary software application, which the different entity wishes to keep confidential from the customer.

If data is communicated over a data cable between the dispensers and a data collection device, the data cable may be expensive to install, especially for retro-fit applications. If the data collection device is a personal computer ("PC") which runs a proprietary application program at a different entity, both the customer and different entity can develop a strained relationship. If the customer opens a port in the customer's network firewall, security concerns are raised, subjecting the customer to possible security breaches by not only the different entity, but from other entities as well, seeking to hack into the customer's system through the firewall.

The present invention provides a communication arrangement which addresses some, or all, of the above concerns about cost, retro-fitting, security, and maintaining good relationships between the customer and different entity performing the data collection and compliance monitoring.

The present invention provides a reliable and cost-effective, low band-width wireless network that can be easily installed either initially, or retro-fitted in an indoor environment, and that is capable of communicating hygiene dispenser status data to an off-site location, while also minimizing the burden on the customer and the customer's personnel, and existing on-site customer's network infrastructure.

BRIEF DESCRIPTION OF THE DRAWING

FIG. 1 is a schematic diagram showing an overall configuration of sensors, hubs, a gateway, and a cellular network.

DESCRIPTION OF THE PREFERRED EMBODIMENT

A preferred embodiment according to the invention will be described, but the invention is not limited to this embodiment.

FIG. 1 is a schematic diagram showing an overall configuration of a communication system for hygiene compliance monitoring according to the invention. The system 10 comprises a plurality of sensors S. Each sensor S collects hygiene compliance data of a hygiene fixture, such as a sink with a dispenser which dispenses hygiene product either manually or automatically (or both) as requested, or in response to, a user's presence. Examples of sensors are disclosed in U.S. Patent Application Publications 2006/0273361 and 2006/0273915, which are incorporated herein by reference. Briefly, a sensor will collect and store hygiene compliance data, such as the identity of persons, at what times in the day such persons have performed a hygiene procedure, and whether such hygiene procedure has been correctly performed correctly according to a hygiene protocol. Variations of such compliance data may occur as understood by those skilled in the art.

The sensors may be embedded in the dispensers and may detect, and then transmit, or broadcast, data representing each dispenser activation and hygiene compliance event. Hubs H, located within reception range of a plurality of sensors, will receive the transmitted data and re-transmit the data to a gateway G, servicing a plurality of hubs H. The gateway G will then transmit the data over a cellular network CN to a remote server RS with database store. The remote server RS can be connected to the internet, and remote users RU can log onto the remote server RS with appropriate password over the internet, and retrieve the remote dispenser activation event data for processing and analysis, such as generating hygiene compliance reports.

The transmission range of the sensors S may be on the order of 50 feet, or more, to ensure that respective hub H can receive the transmitted data. The transmission of the hub H will preferably have a longer range of 100 feet or more to ensure that the gateway G will receive the transmitted data from the hubs H.

The above-described topology will provide a network at good-performance and low-cost, avoiding hand-wiring of both original and retro-fit installations.

Hubs H can be located throughout a customer facility. In addition to receiving data from sensors S, and transmitting to a gateway G, the hubs H can also, or alternatively, function as repeaters, relaying data from one hub to another to the gateway G. Good radio frequency (RF) coverage will thus be obtained, while allowing the sensors to operate at low-power levels, thereby extending battery life. By having the hubs H, which are less costly than a gateway G, serve as repeaters, savings can result by having only one gateway G at a facility, although it may be useful to have a plurality of gateways G for redundancy in case of a failure of a gateway G. Hubs H can also be provided with ranges in an overlapping manner, so that even if a hub H becomes inoperative or loses power, the remaining hubs H can provide the transmission and repeating operations.

The gateway G uses a cellular modem to transmit the data over a cellular network. As cellular modems are relatively costly to acquire and operate, minimizing the cellular modem count to a low number, even one, will minimize installation and operating costs.

The sensor S and hubs H may operate on 900 MHz or 2.4 GHz bands, but preferably will operate at 433 MHz to avoid interference with the former two bands which are popular and crowded. Also, the 433 MHz band is better able to penetrate obstacles, like walls. As other less crowded frequency bands become available, they may be used as well. Spread spectrum transmission may be used to reduce noise and/or interference.

Each sensor S is preferably self-powered with a battery so that it can be used with existing manual and touch-free dispensers, which do not presently have power available to power the sensor. The sensor S, especially for a manual dispenser, may have a mechanical interface such as a contact closure, magnetic reed switch, or Hall-effect sensor. The preferred interface is the contact closure as this is the most reliable.

The dispensers preferably have an "expansion port". The expansion port may have an active low 3.3V logic level pin available with a 100 KΩ pull-up resistor. This pin goes active during the dispenser pump cycle which is about one second in duration. However, the manual dispenser's activation could be much shorter. To make the sensor compatible with both the manual and touch-free dispensers, the 100 KΩ pull-up resistor may be removed from the touch-free dispenser. The sensor will have a 100 KΩ pull-up resistor which makes the contact closure interface self-contained and eliminates the need to add a pull-up resistor and Vcc source to the manual dispenser.

The manual dispenser is different from the touch-free because it is completely under user control. The sensor should be able to detect an activation event with a minimum duration of 100 ms. A user may not fully depress the push bar or push it very quickly causing the limit switch (contact closure) to only be closed for a short period of time. The sensor may be designed to detect up to 100 consecutive activation events in rapid succession. It is not uncommon for users to take multiple doses very rapidly. The sensor should be able to buffer up to 100 consecutive activation events in rapid succession also buffering a time offset, for each activation, based on the first activation in a rapid succession series (see Table 1). Buffering will also be preferred if one or more activations occur while the sensor is transmitting. The time offset will allow the hub to recognize the buffered activations as valid. The time offset can be added, by the hub, to the time stamp of the first activation thus resolving the time of activation for the buffered event. The time stamp will have a resolution of 1 second so it is possible that more than one valid activation will have the same time stamp. When the buffer is empty, the time offset will be cleared to 0.

Some sensors may be within range of more than one hub. This will result in multiple hubs collecting activation event data from one sensor. The remote server can detect and discard duplicate activation events before storing them in a database. More than one activation can have the same time stamp from the same sensor. To allow the server to distinguish between valid activations with the same time stamp and duplicate activations with the same time stamp, an 8-bit counter (see table 1) can be incremented with each activation. If the server sees two activations with the same time stamp from the same sensor but different counts, both activations are valid, otherwise one is a duplicate and can be discarded.

Multiple hubs may not have perfectly synchronized real-time clocks (RTC). In the case where two or more of these out of sync hubs are within range of a single sensor, each may record and time stamp the same activation event but the time stamps will not match. This creates a situation that makes it difficult for the remote server to detect duplicate activations unless an 8-bit activation count is implemented by the sensor.

TABLE 1

Possible Rapid Successive Activation Scenario

| Activation Event | Time | Time Offset | 8-Bit Counter | Time Stamp |
|---|---|---|---|---|
| | 02:42:15.0 | 0 ms | 253 | 02:42:15 |
| | 02:42:15.1 | 100 ms | 254 | 02:42:15 |
| 1 | 02:42:15.6 | 600 ms | 255 | 02:42:15 |
| 2 | 02:42:16.1 | 1,100 ms | 0 | 02:42:16 |
| | No Activity | | | |
| 1 | 02:55:38.5 | 0 ms | 1 | 02:55:38 |
| | No Activity | | | |
| 1 | 02:56:03.7 | 0 ms | 2 | 02:56:03 |
| | No Activity | | | |
| 1 | 03:11:26.4 | 0 ms | 3 | 03:11:26 |
| 2 | 03:11:26.8 | 400 ms | 4 | 03:11:26 |

The sensor will create an 8-byte event record for each activation that occurs (see Table 2). This record will be transmitted to the nearest hub. The event record will contain a factory programmed 32-bit device address that is unique to the sensor, an 8-bit device ID that will distinguish the current sensor from other sensors designed in the future, an 8-bit event ID to identify what kind of event occurred, an 8-bit activation count to identify duplicate event records and an 8-bit time offset to resolve activation time for multiple events occurring before they can be transmitted.

TABLE 2

8-Byte Sensor Event Record

| Device ID | Address Byte 0 | Address Byte 1 | Address Byte 2 | Address Byte 3 | Event ID | 8-Bit Activation Count | Time Offset |
|---|---|---|---|---|---|---|---|

The Address Bytes 0-3 may have a factory-programmed value between 0 and 4,294,967,296 that is unique for each sensor The Device ID may have a value from 0 to 255 that identifies the type of sensor from which the event record originated. The value for the current sensor (type 1) will be 0.

The Event ID may have a value from 0 to 255 that identifies the type of event that occurred. The current sensor (type 1) only has one event, a contact closure (dispenser activation). Sensors may have more event options such as cover open, cover closed, low battery, object blocking dispenser's IR etc. The value for a dispenser activation event will be 0.

The 8-Bit Activation Count may have a value between 0 and 255 that is incremented with each activation event. Consecutive activation events should not have the same number. When the count reaches 255, it will circle back to 0 on the following activation.

The Time Offset may have a value from 0 to 255 that, for the current activation, represents the amount of time that has passed since the first previous activation that has not yet been transmitted. The time offset value may be in 100 ms intervals i.e. 0=0 ms, 1=100 ms, 2=200 ms etc. It is possible to compress several of the above bytes into 4-bit upper and lower nibbles if the power budget requires it.

An alternative to the above-described sensors S will now be described.

A header on the dispenser's PCB may be available with power and an $I^2C$ or similar interface for an embedded sensor which would be mounted directly to the dispenser's PCB. By having a communication interface directly to the dispenser's μC, the sensor may be able to transmit not only an activation event but also low battery level, cover opened, cover closed and IR obstruction events. Dispenser configuration information such as dose setting (1, 2, 3), IR range (long, short), battery level, etc. could also be transmitted at the request of a remote user. This information could be used to remotely monitor the health and configuration of a customer's dispenser. For example, the remote server could be configured, by a remote user, to generate a warning email that would automatically be sent to a customer with a list of individual dispensers that have low batteries allowing the customer to preempt dispenser failure.

The sensor may have more communication demands made of it than the first-described sensor, and therefore, will likely consume more power. An external power source may be necessary. This means that the sensor will only be used with the touch-free dispenser and use the dispenser's D-cell batteries as its power source.

The function of the hub H is to receive, time-date stamp and buffer activation data (event records) transmitted from the surrounding sensors within its range. It then passes this data along to the nearest hub or gateway when it is requested.

The hub H should preferably be able to receive transmitted data from sensors a minimum of 50 feet away in an indoor environment. Indoor range is a subjective term so it will be assumed that the signal will only pass through a maximum of two interior walls composed of drywall and metal studs or that the signal will only pass through one exterior wall, firewall, or floor, composed of formed concrete with embedded rebar.

The hub H should preferably be able to process up to 100 sensors and up to 20 sensors transmitting activation events at the same time. A hub typically processes one event at a time so a maximum time-date stamp latency of 10 seconds may be used. This should allow enough time for each individual sensor event to be processed by the hub Each hub may be equipped with a battery backed real-time clock (RTC) with a minimum accuracy of +/−5 ppm. The gateway should attempt to update each hub's RTC at least once every 24 hours to keep all hubs synchronized. When a sensor's activation event is received, the hub will do the following: (1) log the event record; (2) log the current time of the RTC to create a time-date stamp for the event; (3) check the event record's time offset byte; (4) if time offset byte is not equal to 0, adjust time-date stamp accordingly; and (5) buffer event record with time-date stamp in circular queue. Some MSP430 μCs have a built-in RTC. This would eliminate the need for the hub to deal with time offset and keep things simple.

A circular queue may be used to buffer the last 10,000 activation events for all sensors within the hub's range. The queue will also serve as a local archive so that the remote server can request past events that may have been lost or corrupted. When the queue is full, new events will overwrite the oldest buffered events.

The hub may also function as a repeater. This wireless topology attempts to minimize the number of gateways required to send data to a remote server. To do so, hubs that are out of the gateway's range will transmit and receive data from hubs that are within their range. In turn, these hubs will transmit and receive data from hubs within their range until the data finally reaches a gateway. This forwarding of data from one hub to another will form a simple ad hoc or mesh type of network. Each hub may be able to transmit to and receive data from other hubs or a gateway a minimum of 100 feet away in an indoor environment. The signal may pass through a maximum of two interior walls composed of drywall and metal studs. It will also be assumed that the signal may only pass through one exterior wall, firewall, or floor composed of formed concrete with embedded rebar. External power may be required due to the large distance and communication demands placed on the hub. The hub may be powered from an external 6 VDC to 12 VDC source such as a class 2 transformer.

When activation event data is requested by the gateway, the hub will send the event record as in Table 3:

TABLE 3

| | | |
|---|---|---|
| Hub Device ID | = 0-255 | 8-bit device ID to identify type of device (100 for the hub) |
| Hub Address Byte 0 | = 0-255 | 32-bit (bytes 0 thru 3) hub address |
| Hub Address Byte 1 | = 0-255 | |
| Hub Address Byte 2 | = 0-255 | |
| Hub Address Byte 3 | = 0-255 | |
| Event Time Stamp Hours | = 0-23 | Hours time stamp applied when event record is received from sensor |
| Event Time Stamp Minutes | = 0-59 | Minutes time stamp applied when event record is received from sensor |
| Event Time Stamp Seconds | = 0-59 | Seconds time stamp applied when event record is received from sensor |
| Event Time Stamp Month | = 0-23 | Month time stamp applied when event record is received from sensor |
| Event Time Stamp Day | = 1-31 | Day time stamp applied when event record is received from sensor |
| Event Time Stamp Year | = 0-99 | Year time stamp applied when event record is received from sensor |
| Sensor Device ID | = 0-255 | 8-Bit Device ID to identify type of device |
| Sensor Address Byte 0 | = 0-255 | 32-Bit (bytes 0 thru 3) sensor address |
| Sensor Address Byte 1 | = 0-255 | |
| Sensor Address Byte 2 | = 0-255 | |
| Sensor Address Byte 3 | = 0-255 | |
| Sensor Event ID | = 0-255 | 8-bit event ID to identify type of event that occurred |
| Sensor Activation Count | = 0-255 | 8-bit count sensor activation count |

The data in Table 3 may be in binary form using a proprietary protocol. This would make the data sufficiently difficult to decipher and eliminate the need for encryption. It is possible to compress the time-date stamp data but it is being presented in its current form to make parsing easier. Hub device ID, sensor event ID and sensor device ID may be included.

Hub installation is preferably as simple as possible. One should determine what sensors, hubs, or gateways are within range. An installer should preferably have a laptop PC available during installation. This will allow the use of a software tool that can be used to configure the hub (if necessary) and determine what devices are within range. The hub will have a half-duplex RS-485 serial port that will allow connection to the installer's PC.

The hub may be able to "discover" what other devices are within range without the need for the installer to intervene. This would be possible because each device will have a unique device ID and address combination. Discovery needs to occur within a reasonable amount of time because installers will charge by the hour.

The device may use a custom sheet metal enclosure or an ABS enclosure. Depending on size, mounting holes will be available in the PCB for fasteners. All connectors are preferably mounted at the PCB's edge for access through enclosure. Enclosure may be made of 1.5 mm steel or aluminum, with 2.50 mm from edge of PCB to outside surface of enclosure for connector placement. A right angle PCB mount SMA connector could be used so the antenna can be attached to the hub by the installer.

If the dispenser is empty, a user may try to simulate a dispensing of hygiene product by standing in front of the dispenser so that his presence and identity is sensed, even though the user will not cleanse his hands. To address this potential problem, the dispenser has a button which can be pressed by a user to signal that the dispenser is empty of hygiene product, or in need of other service such as maintenance (e.g., cleaning) or repair. In addition, or in the alternative, the dispenser can have a sensor which can detect when the dispenser is empty of hygiene product, the amount of hygiene product remaining, or maintenance or repair service.

The reading of the button and/or sensors can be transmitted to a local server, remote server, offsite server or the like. The information can be transmitted, if necessary, through one or more hubs, through the gateway and then over the cellular network. The system can thus monitor the amount of hygiene product remaining, and when a dispenser needs to be filled, as well as any needed maintenance or repair. By tracking consumption, the system can provide predicted "run-out" times, and generate messages for dispensers to be refilled, the dispenser can be reset, or the capacity sensor will sense that the dispenser is filled.

The information sent would include the dispenser's address (location), time, date and a flag indicating that the dispenser is empty, the amount of hygiene product remaining, and the current operative "status" including operation OK, or need for maintenance or repair. The system can periodically "poll" the dispensers to request the status of each dispenser and how much hygiene product is remaining.

When a user presses a button, the dispenser will send a message, which could be over a 433 MHz wireless network, with the dispenser's address, time, date and flag indicating "dispenser empty" or other operative status. When the message reaches the offsite server, after being transmitted through the hub and gateway, the server will process the message and send an alert to appropriate personnel by email, SMS text message, phone message and/or other method of communication. The alert can be configured to display on a web-based software graphic user interface.

The offsite server is configured at setup/installation with the various locations of each of the dispenser addresses. This will allow the appropriate personnel receiving the alert to know the physical location of the dispenser that needs a refill or other service, as well as the time and date that it was reported to need refilling or service.

As mentioned previously, one or more sensors in the dispenser could be provided to detect the amount of hygiene product remaining in the dispenser, and the sensors could automatically transmit the information to the server. The transmission could be at a periodic time interval, or when the product reaches certain quantity amounts remaining, such as ½, ¼, etc., or 10 oz., 5 oz., etc. A program in the sensor could also track consumption rates of each dispenser, and be used to track the consumption rate at that dispenser and predict the time when the dispenser should be refilled before it gets completely empty, or other routine service such as cleaning, battery replacement, etc.

Although a preferred embodiment has been described, the invention is not limited to this embodiment and the scope of the invention is defined by the following claims.

APPENDIX A

DEVICE ID ASSIGNMENT

| Device | ID | Description |
|---|---|---|
| N/A | 0 | Broadcast to all device types |
| ProGiene G3 | 1 | ProGiene G3 touch-five group hand hygiene monitoring dispenser |
| ProSense Controller | 2 | ProSense touch-five faucet controller |
| RESERVED | 3 | Reserved for future use |
| ProGiene Data Logger | 4 | Hand held data logger for ProGiene G3 virtual network |
| Sensor T1 | 5 | Wireless sensor type 1 - contact closure event |
| Sensor T2 | 6 | Wireless sensors type 2 - multi-event with PC interface |
| Hub | 100 | Wireless hub/repeater |
| Gateway | 101 | Wireless gateway with embedded GSM modem |
| RESERVED | 250 | Reserved for future use |
| RESERVED | 251 | Reserved for future use |
| RESERVED | 252 | Reserved for future use |
| RESERVED | 253 | Reserved for future use |
| RESERVED | 254 | Reserved for future use |
| Master | 255 | Master device for master/slave RS-485 protocol |

APPENDIX B

EVENT ID ASSIGNMENT

| Event | ID | Description |
|---|---|---|
| RESERVED | 0 | Reserved for future use |
| Dispenser Activation | 1 | Contact closure - dispenser activation |
| Dispenser Cover Opened | 2 | Dispenser's cover was opened |
| Dispenser Cover Closed | 3 | Dispenser's cover was closed |
| Object Blocking IR | 4 | Object placed under dispenser within IR range |
| Object Blocking IR Removed | 5 | Object under dispenser within IR range removed |
| RESERVED | 250 | Reserved for future use |
| RESERVED | 251 | Reserved for future use |
| RESERVED | 252 | Reserved for future use |
| RESERVED | 253 | Reserved for future use |
| RESERVED | 254 | Reserved for future use |
| RESERVED | 255 | Reserved for future use |

The invention claimed is:

1. A communication system for hygiene compliance monitoring comprising:

a central monitoring station; and a plurality of dispensers that dispense hygiene product, each dispenser including:

a transmitter that transmits data indicating a status of the dispenser to the central monitoring station;

a capacity sensor that senses whether the dispenser is filled to capacity with hygiene product;

a sensor that detects the amount of hygiene product remaining in the dispenser; and a cover open/closed sensor that detects if a cover of the dispenser is open or closed;

wherein the status of the dispenser indicates when the dispenser is in need of repair, when the dispenser is in need of cleaning, when the dispenser is empty of hygiene product, when the dispenser requires battery replacement, whether the cover is open, and the amount of hygiene product remaining in the dispenser.

2. The system of claim 1, wherein each dispenser has a switch for activation by a user to indicate that the dispenser needs refilling.

3. The system of claim 1, wherein the transmitter transmits data indicating the status periodically.

4. The system of claim 1, wherein the transmitter transmits data indicating the status when the product remaining in the dispenser needs refilling.

5. The system of claim 1, wherein the data indicating the status includes the identity of the dispenser.

6. The system of claim 1, wherein the data indicating the status includes a time stamp.

7. The system of claim 1, wherein the central monitoring station stores the data received and calculates a projected time for refilling the dispenser before hygiene product is depleted.

8. The system of claim 1, wherein the transmitter transmits the data wirelessly.

9. The system of claim 1, wherein the central monitoring station transmits an alert signal after receiving data from the dispenser indicating that a dispenser is empty of hygiene product.

10. The system of claim 9, wherein the alert signal is at least one of an email message, SMS text message or phone message.

11. The system of claim 1, wherein the central monitoring station transmits a polling signal to each dispenser to poll the status of the dispenser, and wherein the dispenser transmits the data in response to receipt of the polling signal.

12. The system of claim 11, wherein the central monitoring station transmits the polling signal periodically.

13. The system of claim 1, wherein each of the plurality of dispensers are one of a manual or a touch-free dispenser.

* * * * *